United States Patent [19]

Dlugopolski

[11] 4,119,265

[45] Oct. 10, 1978

[54] SEAMLESS LEAKPROOF CONTAINER

[75] Inventor: Joseph Dlugopolski, Lombard, Ill.

[73] Assignee: Fidelity Container Corporation, Chicago, Ill.

[21] Appl. No.: 827,557

[22] Filed: Aug. 25, 1977

[51] Int. Cl.[2] ..... B65D 5/22; B65D 5/24

[52] U.S. Cl. ..... 229/31 R; 229/31 FS

[58] Field of Search ..... 229/31 R, 31 FS

[56] References Cited

U.S. PATENT DOCUMENTS

| | | | |
|---|---|---|---|
| 2,846,132 | 8/1958 | Carpenter | 229/31 R |
| 2,909,105 | 10/1959 | Lawrence | 229/31 R |
| 2,914,234 | 11/1959 | Hazelwood | 229/31 R |
| 3,067,924 | 12/1962 | Baker et al. | 229/31 FS |
| 3,146,933 | 9/1964 | Moore | 229/31 R |
| 3,246,829 | 4/1966 | Sexton | 229/31 R |
| 3,335,935 | 8/1967 | McCallum | 229/31 R |
| 3,606,078 | 9/1971 | Phillips | 229/31 FS |
| 3,734,391 | 5/1973 | Manizza | 229/31 R |

*Primary Examiner*—Davis T. Moorhead
*Attorney, Agent, or Firm*—Laff, Whitesel & Rockman

[57] ABSTRACT

A single and unitary, generally rectangular blank is preferably made of corrugated cardboard, with a waterproof surface. On the corners of the blank, a pair of triangular panels are brought together, in a V-fold, and into a face-to-face contact. Then, the corner panels are folded over the ends of a box as the four sides of the rectangular blank are raised to form the side and end panels of a five-sided box. A cover panel is integrally joined to one edge of a side panel, to swing down and close the box. While the leakproof box has many uses, it is presently thought that it will primarily be used to ship frozen poultry.

8 Claims, 7 Drawing Figures

SEAMLESS LEAKPROOF CONTAINER

This invention relates to seamless, leakproof packaging and containers, together with methods of packaging and shipping materials which tend to leak.

Poultry is one example of a material which has the characteristics which prompted this invention. Freshly butchered poultry tends to leak a substantial amount of fluid over an extended period of time. Sometimes, it is also desirable to freeze the poultry immediately after butchering and while the meat is as fresh as possible. This poses a problem since the draining of fluids requires an elapsed time period which tends to defeat the need for quick freezing.

Heretofore, these conflicting requirements have been resolved by packing the poultry in specially-designed boxes having drainage holes at the bottom. Then, these boxes have been placed in quick-freezing facilities, where they drip until frozen. A result is that the outsides of the boxes have tended to be fairly messy.

Accordingly, an object of this invention is to provide a box which is leakproof and capable of containing all liquids throughout the freezing process. Here, an object is to provide a box which is not damaged by freezing and thawing, while so containing a substantial amount of liquid. In this connection, an object is to provide a seamless box.

Another object of this invention is to provide a six-sided box made from a single and unbroken cardboard blank which may be folded without any open seams or edges below the uppermost surface.

In keeping with an aspect of the invention, these and other objects are accomplished by providing a single and unitary, generally rectangular blank having a waterproof surface. Corners of the blank are brought together in a V-fold and then folded over the end of a box in order to elevate the four sides of the rectangular blank into side and end panels of a five-sided box. A cover panel is integrally joined to one edge of a side panel.

The nature of a preferred embodiment of the invention may be understood from the attached drawings, in which.

Figure 1:
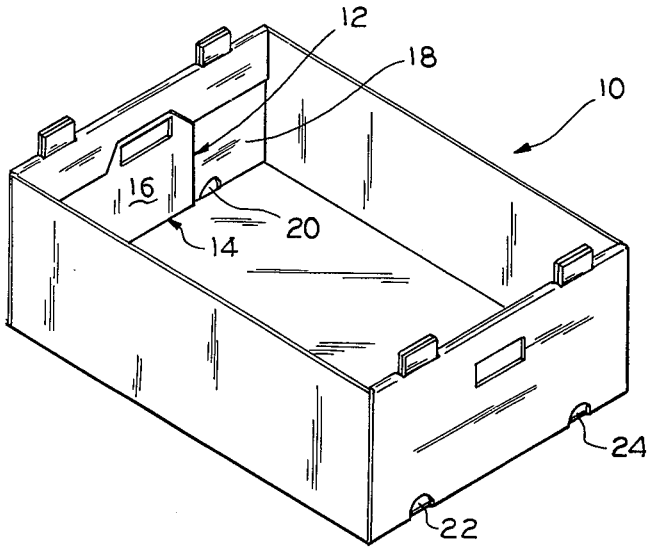
FIG. 1 (PRIOR ART)
FIG. 1 is a perspective view of a prior art box, with drainage holes, which the inventive box is designed to surplant.

The prior art box 10 is seen in FIG. 1. This box is made from a blank which is scored and folded with panels coming together with open edges, as at 12 and 14. There are open passageways thus formed from the inside of the box, through the walls of the box, and to the outside. Accordingly, if fluid-producing material, such as freshly butchered poultry, is placed in the box, fluid tends to collect in the open passageways between panels. For example, in the box of FIG. 1, the abutting wall of panels 16,18 will become and remain wet, with no way of drying out. After the box is thawed, this portion of the box deteriorates quickly.

To forestall such a self-destruction of the box, a plurality of drainage holes pierce the box, as shown at 20,22,24. Thus, any fluids which would otherwise collect in the box, are immediately drained from the box. This does tend to preserve the integrity of the panels, such as 16,18 which would otherwise tend to become saturated and damaged. However, it does not protect the lowermost edges of these panels which will still become wet within the internal spaces between panels 16,18. Also, use of this prior art box leads to an accumulation of residue on the outside of the box, near the drainage holes.

Therefore, while the prior art box of FIG. 1 does solve the problem, it is not an attractive or desirable solution. Also, since the fluids are lost, the thawed poultry tends to be dryer than it would be if freshly butchered. Thus, the thawed meat is not as fresh as it could be.

Figure 2:
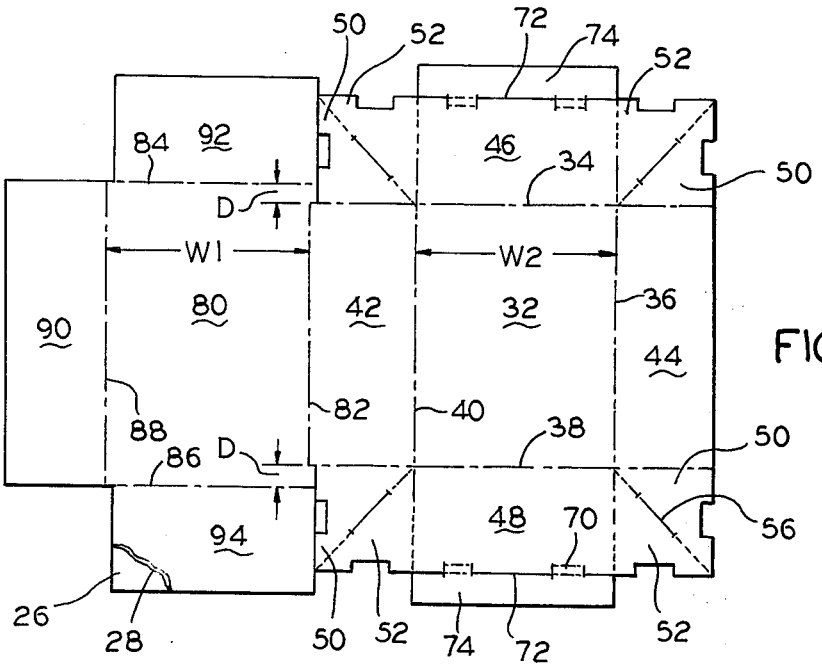
FIG. 2 is a plan view of a cardboard blank which is scored, perforated, and cut, according to the invention.

FIG. 2 shows that the blank for making the inventive box is generally rectangular, with score lines defining a number of individual box panels. The blank is preferably made of corrugated cardboard 26 with at least the inner surface 28 of the blank being coated with any suitable waterproofing material. If desired, the entire blank may be immersed in a waterproof coating.

Figure 3:
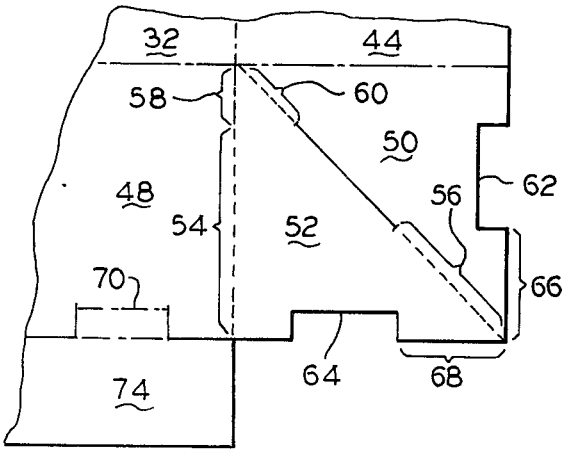
FIG. 3 is an enlarged fragment of a corner of the blank of FIG. 2 showing that portion of the blank which forms the V-fold.

In greater detail, the bottom panel 32 is defined by score lines 34,36,38,40. Integrally attached at these score lines to the bottom panel 32 are a pair of side panels 42,44 and a pair of end panels 46,48. Between each side panel and its adjacent end panel, there are a pair of triangular corner panels, as shown at 50,52, and in large scale in FIG. 3. The corner panels are defined by extensions of the score lines 36,38, for example, which separate the botton panel from its adjacent side and end panels, and by a diagonal score line 56. These triangular panels form a V-fold, at the corner.

To reduce bulk at the folding, the score lines forming corner panels may be partially perforated at their outer ends 54 and 56; however, the perforations will not extend into the sections 58,60 at the root of the corner fold. These unperforated sections extend upwardly far enough to contain any liquids which are normally expected from products regularly packed in the inventive box. Therefore, the integrity of the waterproof surface remains intact throughout the entire expected depth of any fluids expected to collect in the box. Also, the perforations are preferably made from the back and unsurfaced side of the blank so that the front and surfaced side are hardly punctured.

A pair of locking notches 62,64 are formed on the outside edge of each corner panel. When the corner is folded into its completed position, the lands 66,68 formed by these notches 62,64 come together and a locking section 70 passes through notches 62,64, to lock and hold the corner in place. The sections 70 are formed by uncut areas lying along the lines 72 which define a pair of locking end panels or flanges 74 at the outside edges of the end panels.

The top panel 80 is attached to one of the side panels 42 at a score line 82 and further defined by top and bottom score lines 84,86 and an outside score line 88. Three flaps 90,92,94 are integrally joined to the top panel 80 and proportioned to fit over the outside of the completed box. The score lines 84,86 are offset from the score lines 34,38, respectively, by a distance D which is equal to the thickness of the folded corner panels 50,52. Also, the width W1 of the top panel exceeds the width W2 of the bottom panel by the thickness of end panel 44.

Figure 4:
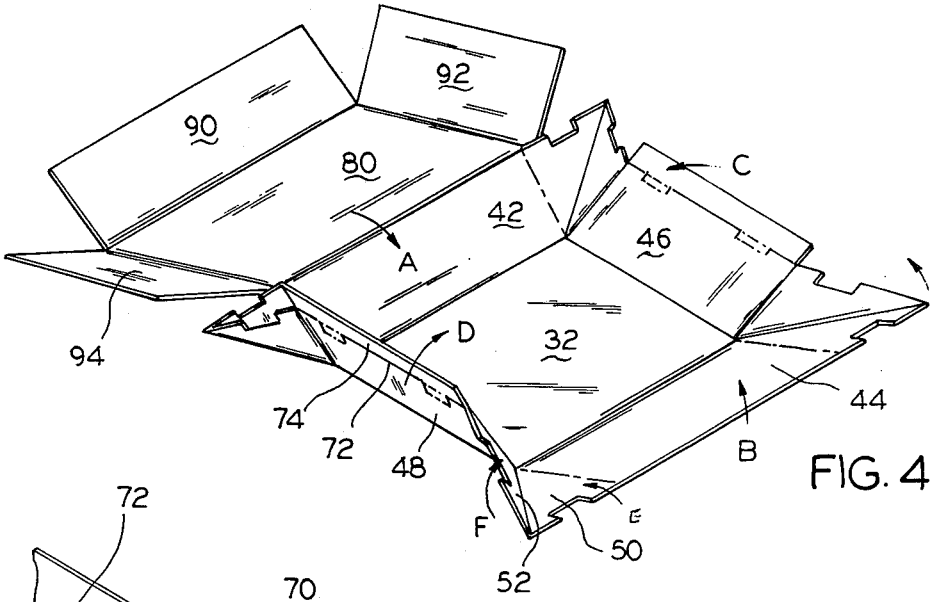
FIG. 4 is a first stop-motion view showing how the corner panels of the box are initially articulated.
Figure 5:
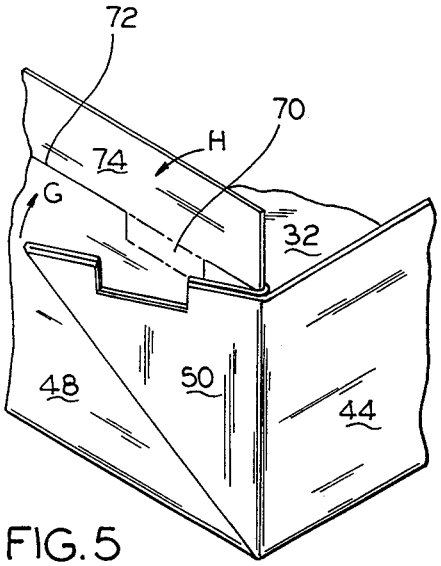
FIG. 5 is a second stop-motion view showing how the articulation of the corner panels are folded to complete the box.
Figure 6:
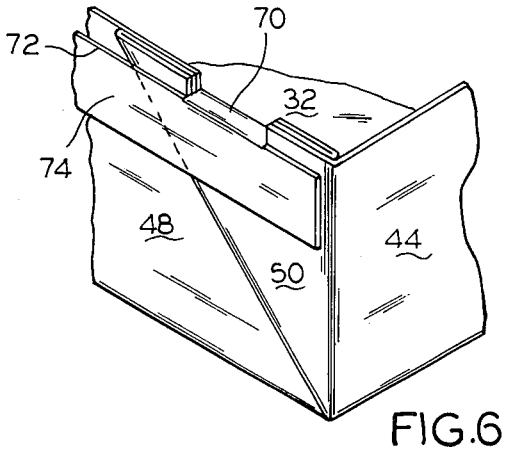
FIG. 6 is a third stop-motion view which shows a locking tab being moved into place to secure the box in position.

The articulation of the blank is seen in the successive steps of FIGS. 4–6. As best seen in FIG. 4, the folding process begins when each of the end and side panels 42,44,46,48 is folded up in the directions A–D, respectively. As this side and end panel folding occurs, the two end panels 50,52 pivot in directions E,F, along the score lines 36,38, respectively. As these score lines 36,38 raise in directions B,D, respectively, the centerfold line 56, in effect moves down relative to the side and end panels 44,48. Thus, the corner panels 50,52 tend to have a generally V-fold.

As the side and end panels 42,44,46,48 reach a perpendicular, relative to the bottom panel 32, the score lines 36,38 become juxtaposed in the corner region. The corner panels 50,52 are in face-to-face contact and there is a sharp crease along the centerfold line 56. Then, the two end panels 50,52 are swung in direction G (FIG. 5), until they come to the flat against the end panel 48 (FIG. 6).

The locking flanges tab 74 is swung in direction H (FIG. 5), about the hinge formed by the locking sections 70. As this happens, the lands 66,68 pass through the windows formed by the cuts 72 (FIG. 6). The locking tab 74 is pressed down until it comes to rest in face-to-face contact against corner panels 50,52 and almost in contact with the end panel 48. Each of the corners and both of the locking tabs fold in the same manner.

Figure 7:
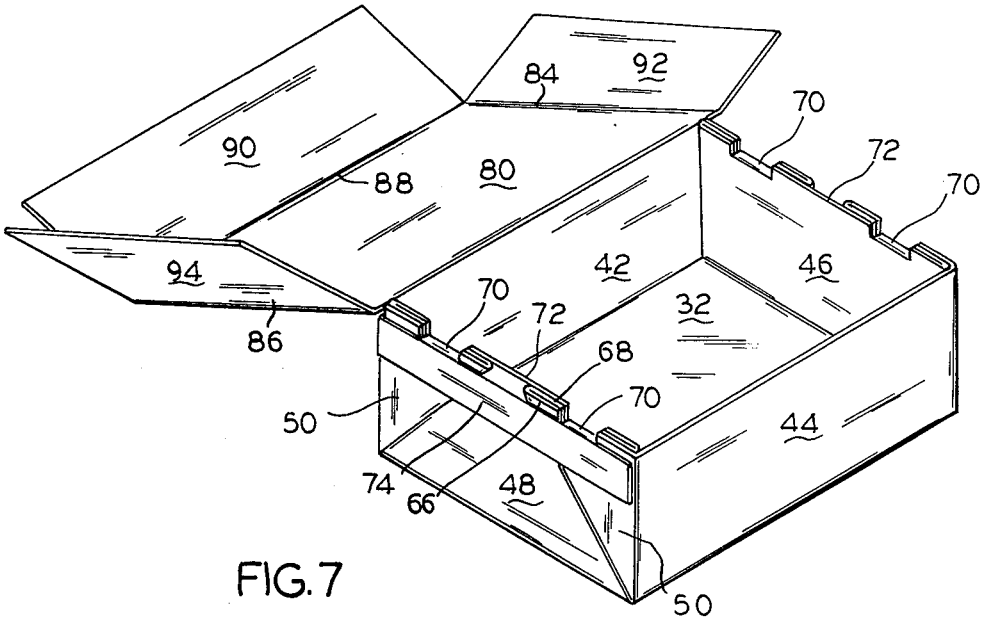
FIG. 7 is a perspective view of a finished box incorporating the invention.

The final step in forming the finished box (FIG. 7) occurs when the top 80 folds over and comes to rest against the upper edges of the side and end panels 42,44,46,48. The three flaps 90,92,94 hinged onto the top 80 at the score lines 84,86,89 fold down over the adjacent end and side panels 44,46,48, respectively. The resulting box is leakproof, at least up to the depth of the unperforated section 58 of the score line 36, and section 60 of the line 56. Above sections 58,60, the box is almost leakproof because the perforations at 54 enter the back of the blank and hardly disturb the waterproof layer 28.

Those who are skilled in the art will perceive how modifications may be made in the disclosed structure. Therefore, the appended claims are to be construed to cover all equivalent structures that may fall within the true scope and spirit of the invention.

I claim:

1. A seamless leakproof box comprising a generally rectangular blank divided by a plurality of score lines into a plurality of panels for integrally forming at least bottom, top, two side and two end panels, a pair of triangular corner panels formed between each side panel and its adjacent end panel, said corner panels being defined by extensions of score lines forming the adjacent side and end panels and by a diagonal score line extending from the intersection of said score lines to the corners of said blank, said pairs of corner panels coming together in a face-to-face relationship responsive to an articulation of the adjoining side and corner panels to a box configuration, said face-to-face pair of corner panels folding to lie flat against an adjacent side or end panel, when folded, each of said face-to-face pairs defining an upwardly facing locking notch perpendicular to said bottom panel, and means comprising an outwardly folding flange attached to said end panels for gluelessly folding outwardly over said end of the box and locking into the notch in said folded corner panels while in said flat position.

2. The box of claim 1 wherein the entire blank is coated with a waterproof surface.

3. The box of claim 1 wherein at least one side of said blank is coated with a waterproof surface.

4. The box of claim 3 wherein said diagonal score line folds out and said pair of corner panels fold in to lie flat against the outside of said box.

5. The box of claim 4 and a top panel hinged at a score line to one of said side or end panels and shaped to fold over the upper edges of said side and end panels and thereby complete a sixth side of a box formed by the bottom, two side and two end panels.

6. A carton blank for a seamless, waterproof carton which is held in a folded form by the simple folding of the blank, said blank comprising a unitary, generally rectangular sheet of corrugated cardboard having at least one waterproof surface, said blank comprising:

b. a second pair of spaced, parallel score lines defining two opposed end panels, two opposed ends of said bottom panel, and two other sides of each of said four corner panels; locking notches being formed along the edges of each of said corner panels at positions which are aligned with each other when the carton is erected.

c. a diagonal score line extending across each of said corner panels from an intersection of one of said first and one of said second score lines to an outside corner of said corner panel, whereby said box folds together with said locking notches aligned without exposing any raw and non-waterproof edges in the interior of said carton; and d. A locking flange attached to each of said two end panels for folding outwardly over said locking notches and holding said corner panels when said locking flanges are folded against the outside of said end panel.

7. The blank of claim 6 and a top panel attached to one of said side panels.

8. The blank of claim 7 wherein said top panel is generally rectangular, one side of said rectangle being attached to said one side panel, and a flap attached to each of the remaining three sides of the rectangle forming said top panel.

* * * * *

UNITED STATES PATENT AND TRADEMARK OFFICE

CERTIFICATE OF CORRECTION

PATENT NO. : 4,119,265

DATED : October 10, 1978

INVENTOR(S) : Joseph Dlugopolski

It is certified that error appears in the above-identified patent and that said Letters Patent are hereby corrected as shown below:

Col. 4, line 31, in Claim 6, before the paragraph beginning with the letter "b" insert the following:

--a. a first pair of spaced, parallel score lines defining two opposed side panels, also two opposed sides of a bottom panel, and also one side of each of four corner panels;--

Col. 4, line 34, after "and" and before "of each" delete "two other sides" and substitute "one other side"

Signed and Sealed this

*First* Day of *December 1981*

[SEAL]

*Attest:*

GERALD J. MOSSINGHOFF

*Attesting Officer*

*Commissioner of Patents and Trademarks*